US009409276B2

(12) United States Patent
Tsai et al.

(10) Patent No.: US 9,409,276 B2
(45) Date of Patent: Aug. 9, 2016

(54) CMP POLISHING PAD HAVING EDGE EXCLUSION REGION OF OFFSET CONCENTRIC GROOVE PATTERN

(71) Applicant: Cabot Microelectronics Corporation, Aurora, IL (US)

(72) Inventors: Ching-Ming Tsai, Jhudong Township (TW); Shi-Wei Cheng, Taoyuan (TW); Jia-Cheng Hsu, Tainan (TW); Kun-Shu Yang, Hsinchu (TW); Hui-Feng Chen, Hsinchu (TW); Gregory Gaudet, Newark, IL (US); Sheng-Huan Liu, Taoyuan Hsien (TW)

(73) Assignee: Cabot Microelectronics Corporation, Aurora, IL (US)

( * ) Notice: Subject to any disclaimer, the term of this patent is extended or adjusted under 35 U.S.C. 154(b) by 0 days.

(21) Appl. No.: 14/515,560

(22) Filed: Oct. 16, 2014

(65) Prior Publication Data

US 2015/0111476 A1 Apr. 23, 2015

Related U.S. Application Data

(60) Provisional application No. 61/892,623, filed on Oct. 18, 2013.

(51) Int. Cl.
*B24B 37/26* (2012.01)

(52) U.S. Cl.
CPC ..... *B24B 37/26* (2013.01)

(58) Field of Classification Search
CPC ..... B24B 37/26
USPC ..... 451/526–539
See application file for complete search history.

(56) References Cited

U.S. PATENT DOCUMENTS

| | | | | |
|---|---|---|---|---|
| 5,177,908 | A | 1/1993 | Tuttle | |
| 5,527,215 | A | 6/1996 | Rubino et al. | |
| 5,645,469 | A | 7/1997 | Burke et al. | |
| 5,650,039 | A | 7/1997 | Talieh | |
| 5,842,910 | A | 12/1998 | Krywanczyk et al. | |
| 5,944,583 | A * | 8/1999 | Cruz | B24B 37/24 451/287 |
| 5,990,012 | A | 11/1999 | Robinson et al. | |
| 6,019,666 | A | 2/2000 | Roberts et al. | |
| 6,089,966 | A | 7/2000 | Arai et al. | |
| 6,120,366 | A | 9/2000 | Lin et al. | |
| 6,159,088 | A * | 12/2000 | Nakajima | B24B 37/26 451/527 |
| 6,241,596 | B1 | 6/2001 | Osterheld et al. | |
| 6,254,456 | B1 | 7/2001 | Kirchner et al. | |
| 6,390,891 | B1 | 5/2002 | Guha et al. | |
| 6,520,843 | B1 | 2/2003 | Halley | |
| 6,520,847 | B2 | 2/2003 | Osterheld et al. | |
| 6,585,579 | B2 | 7/2003 | Jensen et al. | |
| 6,645,061 | B1 | 11/2003 | Bennett et al. | |
| 6,699,115 | B2 | 3/2004 | Osterheld et al. | |

(Continued)

FOREIGN PATENT DOCUMENTS

| | | |
|---|---|---|
| EP | 1 114 697 A2 | 7/2001 |
| EP | 1 284 841 B1 | 3/2005 |

*Primary Examiner* — George Nguyen
(74) *Attorney, Agent, or Firm* — Thomas Omholt; Arlene Hornilla; Francis J. Koszyk

(57) ABSTRACT

The invention provides a polishing pad and a method of using the polishing pad for chemically-mechanically polishing a substrate. The polishing pad comprises at least a grooved region and an exclusion region, wherein the exclusion region is adjacent to the circumference of the polishing pad, and wherein the exclusion region is devoid of grooves.

7 Claims, 7 Drawing Sheets

(56) References Cited

U.S. PATENT DOCUMENTS

| | | | |
|---|---|---|---|
| 6,743,709 | B2 | 6/2004 | Kan et al. |
| 6,783,436 | B1 | 8/2004 | Muldowney |
| 6,824,455 | B2 | 11/2004 | Osterheld et al. |
| 6,843,711 | B1 | 1/2005 | Muldowney |
| 6,896,593 | B2 | 5/2005 | Prasad |
| 6,955,587 | B2 | 10/2005 | Muldowney |
| 6,958,002 | B1 | 10/2005 | Palaparthi |
| 7,059,949 | B1 | 6/2006 | Elmufdi et al. |
| 7,059,950 | B1 | 6/2006 | Muldowney |
| 7,108,597 | B2 | 9/2006 | Muldowney |
| 7,121,938 | B2 | 10/2006 | Suzuki |
| 7,125,318 | B2 | 10/2006 | Muldowney |
| 7,131,895 | B2 | 11/2006 | Elmufdi et al. |
| 7,156,721 | B2 | 1/2007 | Palaparthi |
| 7,234,224 | B1 | 6/2007 | Naugler et al. |
| 7,252,582 | B2 | 8/2007 | Renteln |
| 7,267,610 | B1 | 9/2007 | Elmufdi et al. |
| 7,270,595 | B2 | 9/2007 | Elmufdi et al. |
| 7,300,340 | B1 | 11/2007 | Elmufdi et al. |
| 7,311,590 | B1 | 12/2007 | Muldowney |
| 7,357,698 | B2 | 4/2008 | Choi |
| 7,377,840 | B2 | 5/2008 | Deopura et al. |
| 7,520,796 | B2 | 4/2009 | Muldowney |
| 7,520,798 | B2 | 4/2009 | Muldowney |
| 7,544,115 | B2 | 6/2009 | O'Moore |
| 7,591,713 | B2 | 9/2009 | Soeta |
| 7,614,933 | B2 | 11/2009 | Benvegnu et al. |
| 7,807,252 | B2 | 10/2010 | Hendron et al. |
| 7,867,066 | B2 | 1/2011 | Suzuki |
| 7,927,187 | B2 | 4/2011 | Watanabe et al. |
| 8,057,282 | B2 | 11/2011 | Muldowney |
| 8,062,103 | B2 | 11/2011 | Muldowney |
| 8,123,597 | B2 * | 2/2012 | Chiu ..... B24B 37/26 451/527 |
| 9,180,570 | B2 * | 11/2015 | Kerprich ..... B24B 37/26 |
| 9,211,628 | B2 * | 12/2015 | Allison ..... B24D 11/001 |
| 2002/0068516 | A1 | 6/2002 | Chen et al. |
| 2003/0092371 | A1 | 5/2003 | Osterheld et al. |
| 2004/0014413 | A1 * | 1/2004 | Kawahashi ..... B24B 37/26 451/527 |
| 2006/0019587 | A1 | 1/2006 | Deopura et al. |
| 2006/0046626 | A1 | 3/2006 | Renteln |
| 2007/0197147 | A1 | 8/2007 | Rondum et al. |
| 2009/0311955 | A1 | 12/2009 | Kerprich et al. |
| 2010/0009601 | A1 | 1/2010 | Wang |
| 2012/0190281 | A1 | 7/2012 | Allison et al. |

* cited by examiner

CMP POLISHING PAD HAVING EDGE EXCLUSION REGION OF OFFSET CONCENTRIC GROOVE PATTERN

BACKGROUND OF THE INVENTION

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, layers of metal or glass, and the like. In certain steps of the wafer fabrication process, the uppermost surface of the process layers is desirably planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer typically are rotated above the rotating polishing pad on the CMP tool's polishing table. A polishing composition (also referred to as a polishing slurry) generally is introduced between the rotating wafer and the rotating polishing pad during the polishing process. The polishing composition typically contains one or more chemicals that interact with or dissolve portions of the uppermost wafer layer(s) and one or more abrasive materials that physically remove portions of the layer(s). The wafer and the polishing pad can be rotated in the same direction, in opposite directions, or one of the wafer or polishing pad can be rotated while the other one of the wafer or polishing pad remains stationary. The carrier also can oscillate across the polishing pad on the polishing table. The rotation scheme is chosen according to the particular polishing process being carried out.

It is important in the polishing process to provide sufficient polishing composition between the substrate being polished and the polishing pad. While soft porous polishing pads can act as reservoirs of polishing composition, drawbacks to the use of soft polishing pads have led to the development of harder polishing pads having grooves formed into the surface. The grooves facilitate movement of polishing compositions into the space between the polishing pad and the substrate surface. When the grooves are formed so as to be concentric with the axis of rotation of the polishing pad, in the case of circularly grooved polishing pads, the raised regions of the pad that lie outside of the grooves tend to result in non-uniform polishing of the substrate due to the development of a pattern in the substrate matching the pattern on the polishing pad. This phenomenon has led to the proposal for the use of polishing pads having an "off center" groove pattern, for example, a pad having concentric circular grooves whose center of concentricity does not coincide with the rotational axis of the polishing pad. However, during the formation of the grooves, such as by machining, the groove pattern runs off one side of the polishing pad surface. Because the polishing pad material must necessarily be at least somewhat soft and because many polishing pads are at least somewhat porous, the edge of the polishing pad typically has defects where the grooves meet the edge of the polishing pad that result either from the process used to form the grooves or that form during the polishing process. The edge defects of the polishing pad in turn results in the production of scratching defects in a substrate being polished.

Thus, there remains a need in the art for improved polishing pads.

BRIEF SUMMARY OF THE INVENTION

The invention provides a polishing pad, wherein the polishing pad is characterized by a generally circular cross section, wherein the polishing pad comprises an axis of rotation and a polishing surface, wherein the polishing surface comprises at least a grooved region and an exclusion region, wherein the grooved region comprises a plurality of grooves set into the polishing surface, wherein the plurality of grooves is composed of at least a first plurality of concentric grooves having a first center of concentricity, wherein the axis of rotation of the polishing pad is not coincident with the first center of concentricity, wherein the exclusion region is devoid of grooves, wherein the exclusion region is adjacent to the circumference of the polishing pad, wherein the exclusion region has an outer boundary and an inner boundary, wherein the outer boundary of the exclusion region is contiguous with the circumference of the polishing pad, and wherein a distance from the circumference of the polishing pad to the inner boundary of the exclusion region is greater than zero.

The invention also provides a polishing pad, wherein the polishing pad is characterized by a generally circular cross section, wherein the polishing pad comprises an axis of rotation and a polishing surface, wherein the polishing surface comprises at least a grooved region and an exclusion region, wherein the grooved region comprises grooves set into the polishing surface, wherein the grooves are formed in a spiral pattern having a center, wherein the axis of rotation of the polishing pad is not coincident with the center of the spiral pattern, wherein the exclusion region is devoid of grooves, wherein the exclusion region is adjacent to the circumference of the polishing pad, wherein the exclusion region has an outer boundary and an inner boundary, wherein the outer boundary of the exclusion region is contiguous with the circumference of the polishing pad, and wherein a distance from the circumference of the polishing pad to the inner boundary of the exclusion region is greater than zero.

The invention additionally provides a polishing pad, wherein the polishing pad is characterized by a generally circular cross section, wherein the polishing pad comprises an axis of rotation and a polishing surface, wherein the polishing surface comprises at least a grooved region and an exclusion region, wherein the grooved region comprises a plurality of grooves set into the polishing surface, wherein the plurality of grooves is composed of at least a first plurality of concentric or approximately concentric polygonal grooves having a first center of concentricity, wherein the axis of rotation of the polishing pad is not coincident with the first center of concentricity, wherein the exclusion region is devoid of grooves, wherein the exclusion region is adjacent to the circumference of the polishing pad, wherein the exclusion region has an outer boundary and an inner boundary, wherein the outer boundary of the exclusion region is contiguous with the circumference of the polishing pad, and wherein a distance from the circumference of the polishing pad to the inner boundary of the exclusion region is greater than zero.

BRIEF DESCRIPTION OF THE SEVERAL VIEWS OF THE DRAWING(S)

FIG. 1 is a view of the polishing surface of the polishing pad from a perspective perpendicular to the polishing surface.

FIG. 2 is a view of the polishing surface of the polishing pad from a perspective perpendicular to the polishing surface.

FIG. 3 is a view of the polishing surface of the polishing pad from a perspective perpendicular to the polishing surface.

FIG. 4 is a view of the polishing surface of the polishing pad from a perspective perpendicular to the polishing surface.

FIG. 5 is a view of the polishing surface of the polishing pad from a perspective perpendicular to the polishing surface.

DETAILED DESCRIPTION OF THE INVENTION

The invention is illustrated by way of a discussion of FIGS. 1-7 but, of course, illustration in this manner should not be construed as in any way limiting the scope of the invention. The features of the polishing pads described with respect to FIGS. 1-5 are general to a polishing pad of the invention, and therefore the described features can be combined in any suitable manner to result in a polishing pad of the invention. In this regard, FIGS. 1-5 are merely illustrative of the types of grooving patterns that can be used with the inventive polishing pad; however, the dimensions and proportions represented in FIGS. 1-5 are not necessarily representative of the actual dimensions and proportions of a polishing pad of the invention.

The invention provides a polishing pad, wherein the polishing pad is characterized by a generally circular cross section, wherein the polishing pad comprises an axis of rotation and a polishing surface, wherein the polishing surface comprises at least a grooved region and an exclusion region, wherein the grooved region comprises a plurality of grooves set into the polishing surface, wherein the plurality of grooves is composed of at least a first plurality of concentric grooves having a first center of concentricity, wherein the axis of rotation of the polishing pad is not coincident with the first center of concentricity, wherein the exclusion region is devoid of grooves, wherein the exclusion region is adjacent to the circumference of the polishing pad, wherein the exclusion region has an outer boundary and an inner boundary, wherein the outer boundary of the exclusion region is contiguous with the circumference of the polishing pad, and wherein a distance from the circumference of the polishing pad to the inner boundary of the exclusion region is greater than zero.

The first center of concentricity and the axis of rotation can be separated from one another by any suitable distance. For example, the first center of concentricity and the axis of rotation can be separated by a distance of about 0.1 cm or more, e.g., about 1 cm or more, about 2 cm or more, about 5 cm or more, or about 10 cm or more. Alternatively, or in addition, the first center of concentricity and the axis of rotation can be separated by a distance of about 50 cm or less, e.g., about 25 cm or less, about 15 cm or less, or about 10 cm or less. Thus, the distance between the first center of concentricity and the axis of rotation can be within the range bounded by any two of the foregoing endpoints. For example, the distance can be about 0.1 cm to about 50 cm, about 1 cm to about 25 cm, about 2 cm to about 15 cm, or about 2 cm to about 10 cm.

Figure 1:
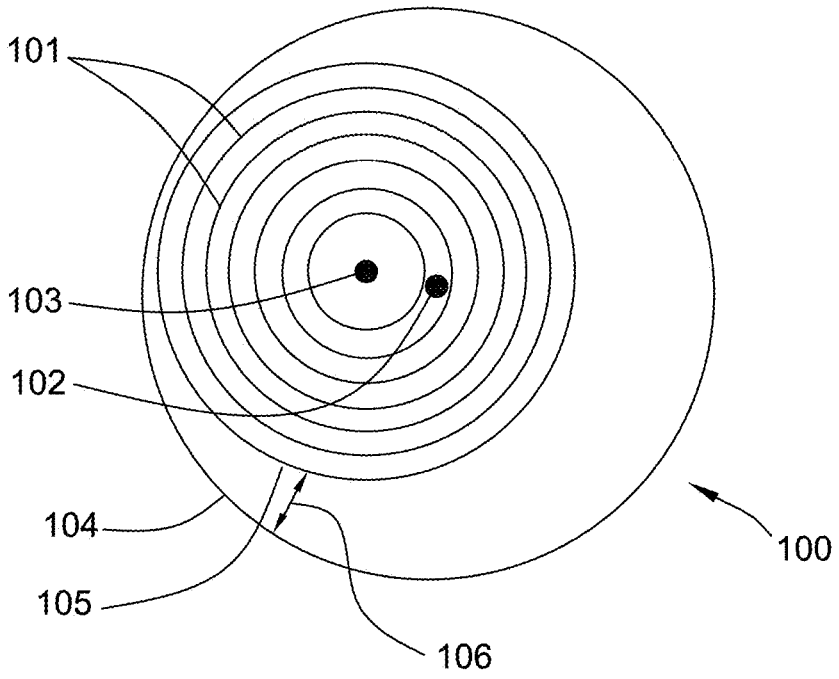
FIG. 1 illustrates a polishing pad according to an embodiment of the invention.

The polishing pad comprises an exclusion region that is devoid of grooves. With reference to FIG. 1, the polishing pad comprises a polishing surface 100, a plurality of concentric grooves 101 set into the polishing surface 100, an axis of rotation 102, a first center of concentricity 103, and an exclusion region defined by an outer boundary 104 and an inner boundary 105, wherein a distance between the outer boundary of the exclusion region and the inner boundary of the exclusion region (D) denoted as 106. Desirably, the distance D is greater than zero.

In any of the embodiments described herein, the distance D is greater than zero. Thus, the grooves cannot extend to the edge, or circumference, of the polishing pad. Typically, the distance D can be about 1 micron or more, e.g., about 5 microns or more, about 10 microns or more, about 25 microns or more, about 50 microns or more, about 100 microns or more, about 250 microns or more, about 500 microns or more, about 1000 microns or more, about 5000 microns or more, about 10,000 microns or more, about 50,000 microns or more, or about 100,000 microns or more. From another aspect, the polishing pad has a thickness T and a circumferential edge, and the thickness of the edge at any point on the circumference of the polishing pad is substantially equal to T.

Alternatively, or in addition, the distance D can be about 10 cm or less, e.g., about 9 cm or less, about 8 cm or less, about 7 cm or less, about 6 cm or less, about 5 cm or less, about 4 cm or less, about 3 cm or less, or about 2 cm or less. Thus, the distance D can be within the range of about 1 micron to 10 cm, e.g., about 1 micron to 5 cm, about 1 micron to 2 cm, about 10 microns to 5 cm, about 10 microns to 2 cm, about 25 microns to 5 cm, about 25 microns to 2 cm, about 50 microns to 5 cm, or about 50 microns to 2 cm.

In some embodiments, the distance D may vary along the circumference of the polishing pad. The average distance from the circumference of the polishing pad to the inner boundary of the exclusion region is denoted by $D_A$. The polishing pad can have any suitable $D_A$. Typically, $D_A$ can be about 0.1 cm or more, about 0.2 cm or more, about 0.4 cm or more, about 0.6 cm or more, about 0.8 cm or more, or about 1 cm or more. Alternatively, or in addition, $D_A$ can be about 2 cm or less, about 1.9 cm or less, about 1.8 cm or less, about 1.7 cm or less, about 1.6 cm or less, or about 1.5 cm or less. Thus, the average distance from the circumference of the polishing pad to the inner boundary of the exclusion region $D_A$ of the polishing pad can be within the range bounded by any two of the foregoing endpoints. For example, $D_A$ can be within the range of about 0.1 cm to about 2 cm, about 0.2 cm to about 2 cm, about 0.4 cm to about 2 cm, about 0.6 cm to about 2 cm, about 0.8 cm to about 2 cm, about 1 cm to about 2 cm, or about 1 cm to about 1.5 cm.

At least a portion of the grooves in the plurality of grooves can be an arc having a shape selected from the group consisting of substantially circular, substantially semi-circular, substantially parabolic, substantially oval, and combinations thereof. In preferred embodiments of the invention, the shape is substantially circular or substantially semi-circular, such that each respective groove in the first plurality of concentric grooves has a substantially constant radius with respect to the first center of concentricity. In certain embodiments, the outermost concentric groove(s) form an arc(s) delimited at each end by the inner boundary of the exclusion region, in order to maintain an exclusion region devoid of grooves, while concentric grooves having a smaller radius than the outermost groove(s) can form complete substantially complete circles.

The average distance from the circumference of the polishing pad to the inner boundary of the exclusion region $D_A$ can have any suitable standard deviation. Typically, $D_A$ can have a suitable standard deviation of about 0.5 or less, about 0.4 or less, about 0.3 or less, about 0.2 or less, or about 0.1 or less.

In an embodiment, the plurality of grooves is further composed of a second plurality of concentric grooves having a second center of concentricity, wherein the first center of concentricity is not coincident with the second center of concentricity, and the axis of rotation of the polishing pad is not coincident with the first center of concentricity and the second center of concentricity.

Figure 2:
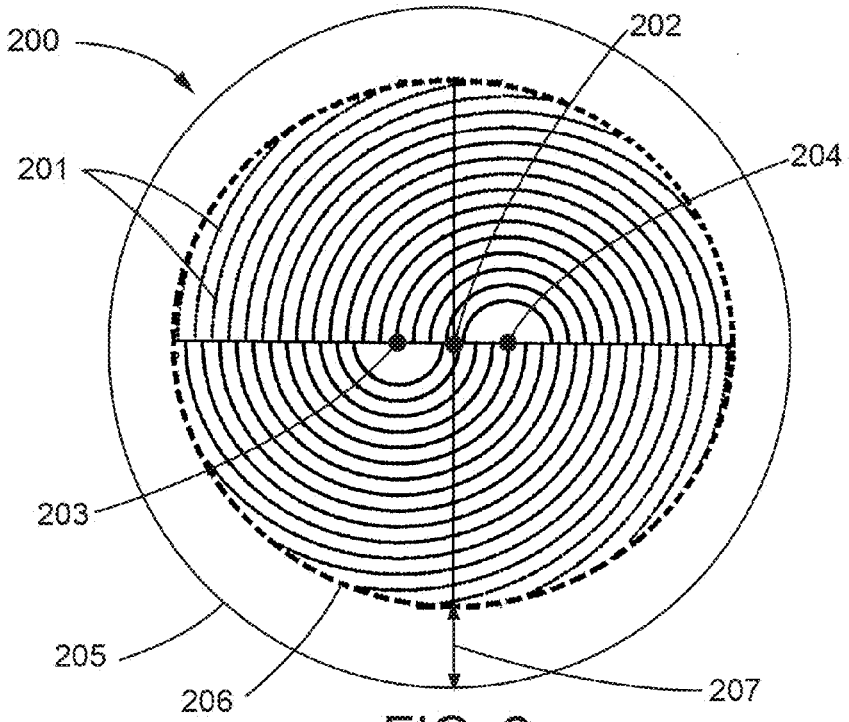
FIG. 2 illustrates a polishing pad according to an embodiment of the invention.

With reference to FIG. 2, in this embodiment the polishing pad comprises a polishing surface 200, a plurality of grooves 201 set into the polishing surface 200, and an axis of rotation 202. The plurality of grooves is composed of a first plurality of concentric grooves 201 having a first center of concentricity 203, and a second plurality of concentric grooves 201 having a second center of concentricity 204. Although, for brevity, only a portion of the grooves in FIG. 2 are labeled in each of the first and second pluralities of concentric grooves, it should be noted that all of the grooves that are concentric about the first center of concentricity 203 are part of the first plurality of concentric grooves 201, and all of the grooves that are concentric about the second center of concentricity 204 are part of the second plurality of concentric grooves 201. The first center of concentricity 203 is not coincident with the second center of concentricity 204, and the axis of rotation 202 is not coincident with either the first center of concentricity 203 or the second center of concentricity 204. The exclusion region lies between the outer boundary 205 and the inner boundary, defined by dotted line 206. The distance between the outer boundary 205 and the inner boundary 206 of the exclusion region (D) is denoted by 207.

Figure 3:
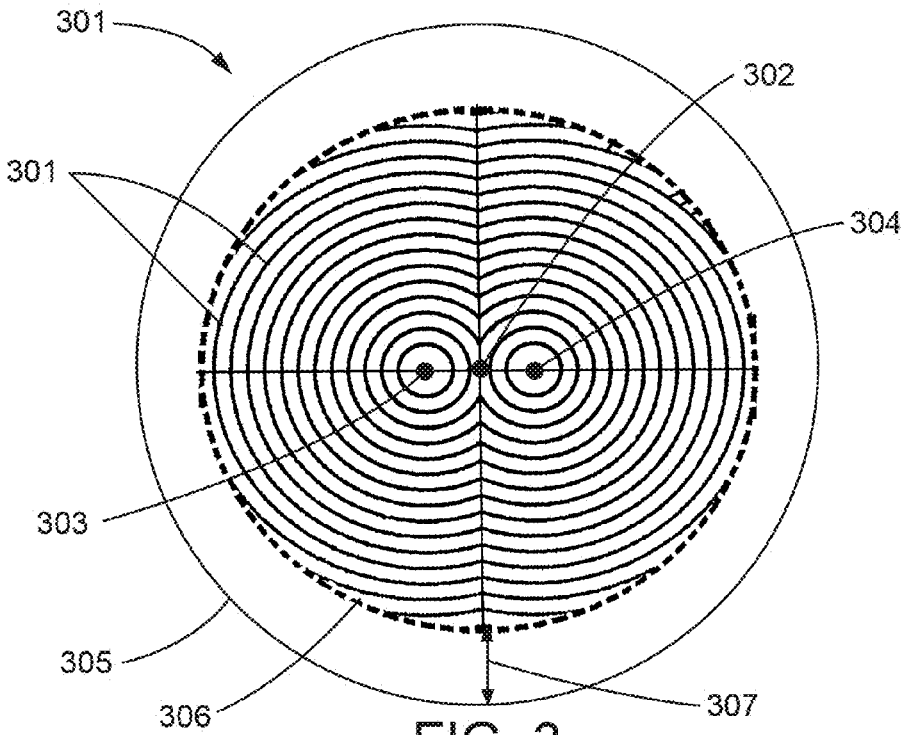
FIG. 3 illustrates a polishing pad according to an embodiment of the invention.

Another embodiment of the inventive polishing pad wherein the polishing pad comprises a first plurality of concentric grooves and a second plurality of concentric grooves is depicted in FIG. 3. The polishing pad comprises a polishing surface 300, a plurality of grooves 301 set into the polishing surface 300, and an axis of rotation 302. The plurality of grooves is composed of a first plurality of concentric grooves having a first center of concentricity 303, and a second plurality of concentric grooves having a second center of concentricity 304. Although, for brevity, only a portion of the grooves in FIG. 3 are labeled in each of the first and second pluralities of concentric grooves, it should be noted that all of the grooves that are concentric about the first center of concentricity 303 are part of the first plurality of concentric grooves, and all of the grooves that are concentric about the second center of concentricity 304 are part of the second plurality of concentric grooves. The first center of concentricity 303 is not coincident with the second center of concentricity 304, and the axis of rotation 302 is not coincident with either the first center of concentricity 303 or the second center of concentricity 304. The exclusion region lies between the outer boundary 305 and the inner boundary, defined by dotted line 306. The distance between the outer boundary 305 and the inner boundary 306 of the exclusion region (D) is denoted by 307.

In the above two embodiments of the invention, at least a portion of the grooves in the plurality of grooves is an arc having a shape selected from the group consisting of substantially circular, substantially semi-circular, substantially parabolic, substantially oval, and combinations thereof. In preferred embodiments of the invention, the shape is substantially circular or substantially semi-circular, each respective groove in the first plurality of concentric grooves has a substantially constant radius with respect to the first center of concentricity, and each respective groove in the second plurality of concentric grooves has a substantially constant radius with respect to the second center of concentricity. Preferably, all of the grooves in the plurality of grooves have the shape as described herein.

Figure 4:
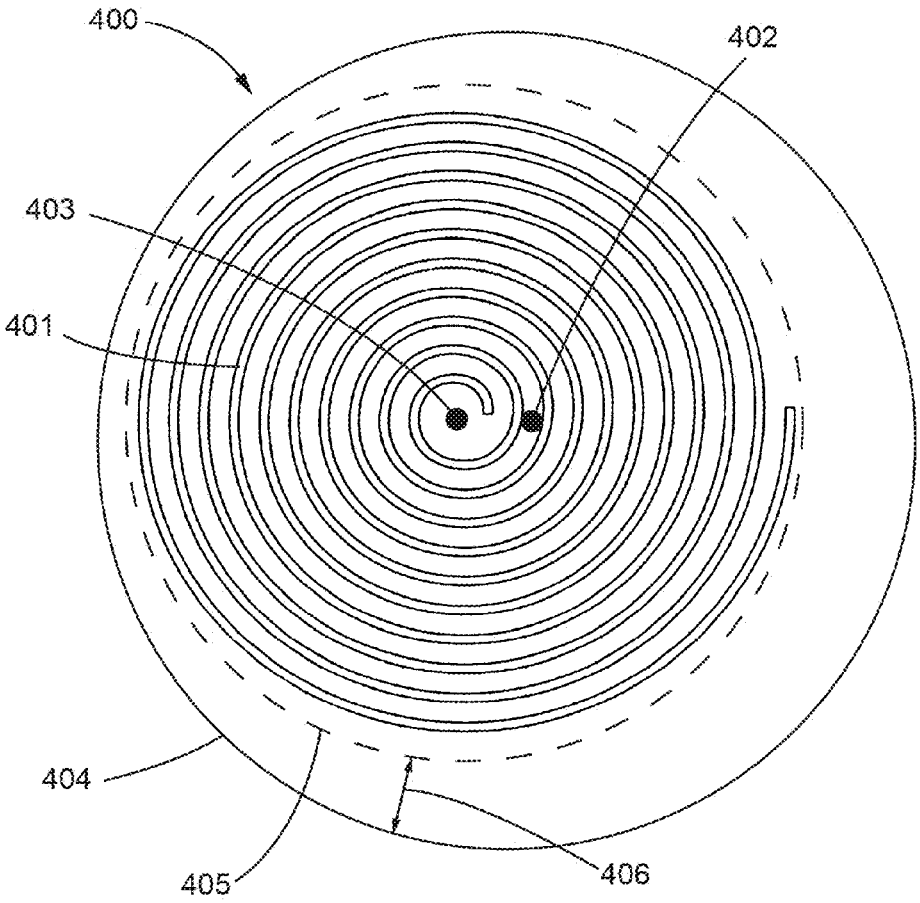
FIG. 4 illustrates a polishing pad according to an embodiment of the invention.
Figure 5:
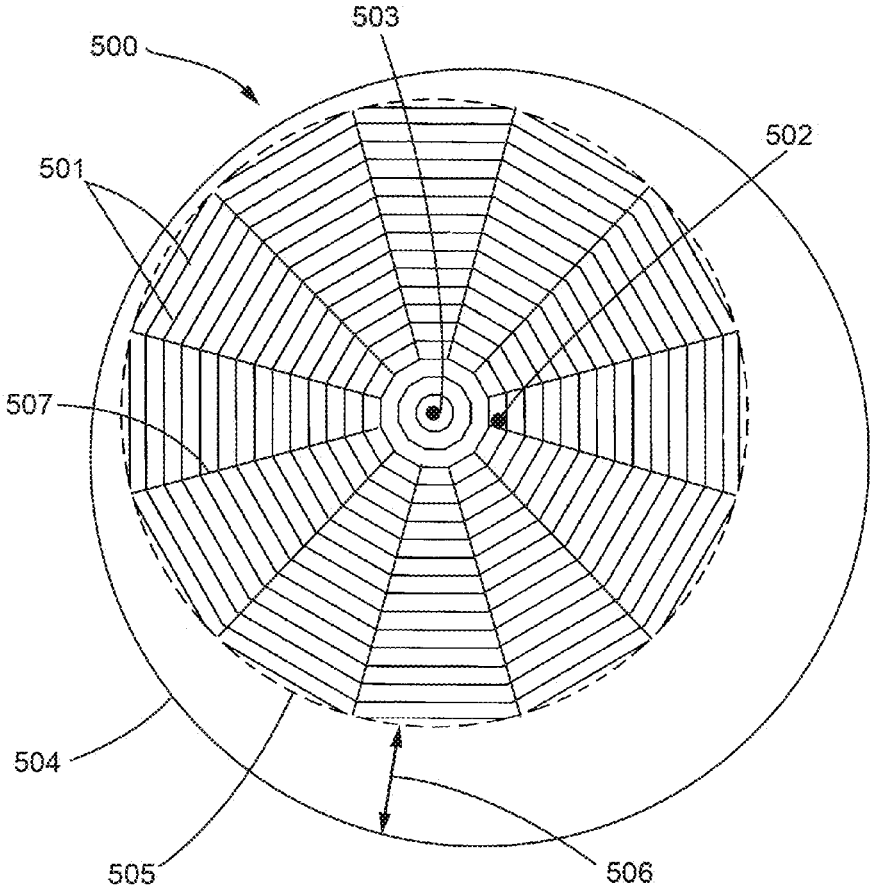
FIG. 5 illustrates a polishing pad according to an embodiment of the invention.

In an embodiment, the plurality of grooves can be in the form of a spiral groove pattern. With reference to FIG. 4, the polishing pad comprises a polishing surface 400, at least one spiral groove 401 set into the polishing surface 400, an axis of rotation 402, and a center of concentricity (i.e., the spiral center) 403. The axis of rotation 402 and the spiral center 403 are not coincident with one another in FIG. 4. The outer boundary of the exclusion region 404 may be coincident with the circumference of the polishing pad as shown in FIG. 4. The inner boundary of the exclusion region is shown by dotted line 405, and the distance between the outer and inner boundaries 404 and 405 of the exclusion zone (D) is denoted by 406.

In an embodiment, the plurality of grooves can be in the form of concentric or approximately concentric polygonal grooves. The polishing pad comprises a polishing surface 500, a plurality of concentric polygonal grooves 501 set into the polishing surface 500, an axis of rotation 502, a first center of concentricity 503, and an exclusion region defined by an outer boundary 504 and an inner boundary defined by dotted line 505, wherein a distance between the outer boundary of the exclusion region and the inner boundary of the exclusion region (D) denoted as 506. In this embodiment, as in any of the embodiments described herein, optional radial grooves 507 may be present.

The polishing pad of the invention can have any suitable cross section shape. For example, the polishing pad can be substantially in the shape of a circle (i.e., circular), oval, square, rectangle, rhombus, triangle, continuous belt, polygon (e.g., pentagon, hexagon, heptagon, octagon, nonagon, decagon, etc.), and the like. As used herein, the term "substantially" in the context of the shape of the polishing pad means that the shape can vary in an insignificant way from a technical definition of the shape at issue, such that the overall shape would be considered by one of ordinary skill in the art to resemble the given shape. For example, in the context of a polishing pad having a substantially circular shape, the radius of the polishing pad (as measured from the geometric center of the polishing pad to the outer edge of the pad) can vary in an insignificant manner (e.g., minor fluctuations) around the entire polishing pad, such that one of ordinary skill in the art would still consider the polishing pad to have a circular shape, despite the situation in which the radius is not entirely constant around the entire polishing pad. In a preferred embodiment, the polishing pad is substantially in the shape of a circle, i.e., the polishing pad has a substantially circular shape.

When the polishing pad is substantially circular or substantially oval-shaped, the polishing pad can have any suitable radius R. When the polishing pad has an oval shape, the radii listed hereinbelow can refer to the long axis and/or the short axis of the oval shape. For example, the polishing pad can have a radius R that is about 10 cm or more, e.g., about 15 cm or more, or about 20 cm or more. Alternatively, or in addition, the polishing pad can have a radius R that is about 52 cm or less, e.g., about 50 cm or less, about 45 cm or less, or about 40 cm or less. Thus, the radius R of the polishing pad can be within the range bounded by any two of the foregoing endpoints. For example, the radius R can be within the range of about 10 cm to about 52 cm, about 15 cm to about 50 cm, or about 20 cm to about 50 cm.

The term "substantially" in relation to the shape of the grooves, as defined herein, means that the grooves have a shape that would be recognized by one of ordinary skill in the art to resemble the recited shape, despite a situation in which the recited shape technically may not meet a rigid textbook definition of the recited shape. For example, in the situation where a given arc groove does not have a constant radius with respect to a center of concentricity, but the radius has a substantially constant radius that varies only insignificantly such that the overall shape would be considered by the ordinarily skilled artisan to resemble a circular or semi-circular shape, then such an arc would meet the definition of "substantially circular" or "substantially semi-circular" as used herein. The terms "circular" and "semi-circular" are interchangeably used herein to describe an arc groove that has a substantially constant radius with respect to a given center of concentricity. The term "substantially constant radius" as used herein means that the radius an arc groove varies only insignificantly such that the overall shape of the arc groove would be considered by one of ordinarily skill in the art to resemble a circular or semi-circular shape.

The plurality of grooves can have any suitable cross-sectional shape. The cross-sectional shape of the grooves, as used herein, is the shape formed by the combination of the groove walls and groove bottom (i.e., the shape of the grooves in a plane perpendicular to the polishing surface of the polishing pad). For example, the cross-sectional shape of the grooves can be U-shaped, V-shaped, square-shaped (i.e., the groove walls and bottoms are formed at about 90° angles), and the like.

The polishing pad of the invention can have any suitable thickness T, as defined by the distance between the polishing surface and the bottom surface of the polishing pad. For example, the thickness T can be about 500 μm or more, e.g., about 750 μm or more, or about 1000 μm or more. Alternatively, or in addition, the thickness T can be about 2500 μm or less, e.g., about 2250 μm or less, or about 2000 μm or less. Thus, the thickness T of the polishing pad can be within the range bounded by any two of the foregoing endpoints. For example, the thickness T can be about 500 μm to about 2500 μm, about 750 μm to about 2250 μm, or about 1000 μm to about 2000 μm.

Each groove in the plurality of grooves can have any suitable depth D and any suitable width W, and can be separated by an adjacent groove by any suitable pitch P. The depth, width, and pitch of each groove in the plurality of grooves can be constant or can vary. When the depth, width, and/or pitch vary, the variation can be systematic or random within the same groove and/or with respect to other grooves.

For example, in the situation where the polishing pad has at least a first plurality of concentric grooves and a second plurality of concentric grooves, the polishing pad can be characterized as follows: (i) the polishing pad has a thickness T, (ii) each groove in the first plurality of concentric grooves has a first depth, has a first width, and is separated from an adjacent groove by a first pitch, and (iii) each groove in the second plurality of concentric grooves has a second depth, has a second width, and is separated from an adjacent groove by a second pitch, wherein one or more of the following conditions is satisfied: (a) the first depth and the second depth measured as a fraction of the thickness T of the polishing pad independently are about 0.01 T to about 0.99 T and can be the same or different, and the first depth, the second depth, or both is constant or varies within the first plurality of concentric grooves, the second plurality of concentric grooves, or both, (b) the first width and the second width independently are about 0.005 cm to about 0.5 cm and can be the same or different, and the first width, the second width, or both is constant or varies within the first plurality of concentric grooves, the second plurality of concentric grooves, or both, and (c) the first pitch and the second pitch independently are about 0.005 cm to about 1 cm and can be the same or different, and the first pitch, the second pitch, or both is constant or varies within the first plurality of concentric grooves, the second plurality of concentric grooves, or both. Although the thickness T of the polishing pad, and the depth, width, and pitch of the grooves is described herein in relation to the situation in which a polishing pad has two pluralities of grooves (i.e., a first plurality of concentric grooves and a second plurality of concentric grooves), the description is equally applicable to the situation in which the polishing pad can have, e.g., three, four, five, six, seven, eight, nine, or ten pluralities of grooves. For example, the polishing pad may have a third plurality of concentric grooves, wherein each groove in the third plurality of concentric grooves has a third depth, has a third width, and is separated from an adjacent groove by a third pitch, etc.

Each groove in the plurality of grooves independently can have any suitable depth measured as a fraction of the thickness T of the polishing pad. For example, the depth of each groove can independently be about 0.01 T or more, e.g., about 0.05 T or more, about 0.1 T or more, about 0.2 T or more, about 0.4 T or more, about 0.5 T or more, or about 0.75 T or more. Alternatively, or in addition, the depth of each groove can independently be about 0.99 T or less, e.g., about 0.95 T or less, about 0.85 T or less, about 0.8 T or less, about 0.75 T or less, about 0.65 T or less, or about 0.55 T or less. Thus, the depth of each groove can independently be within the range bounded by any two of the foregoing endpoints. For example, the depth can be about 0.2 T to about 0.8 T, about 0.4 T to about 0.55 T, or about 0.75 T to about 0.85 T.

Each groove in the plurality of grooves independently can have any suitable depth expressed as a distance measured from the polishing surface to the bottom of the groove. For example, the depth of each groove can independently be about 10 μm or more, e.g., about 50 μm or more, about 100 μm or more, about 100 μm or more, about 1000 μm or more, or about 2500 μm or more. Alternatively, or in addition, the depth of each groove can independently be about 5000 μm or less, e.g., about 4000 μm or less, about 2500 μm or less, about 1000 μm or less, or about 750 μm or less. Thus, the depth of each groove can independently be within the range bounded by any two of the foregoing endpoints. For example, the depth can be about 100 μm to about 750 μm, about 2500 μm to about 5000 μm, or about 1000 μm to about 2500 μm. Preferably, the depth of each groove is independently about 100 μm to about 1000 μm.

Each groove in the plurality of grooves independently can have any suitable width. For example, the width of each groove can independently be about 10 μm or more, e.g., about 50 μm or more, about 100 μm or more, about 200 μm or more, about 300 μm or more, about 400 μm or more, or about 500 μm or more. Alternatively, or in addition, the depth of each groove can independently be about 5000 μm or less, e.g., about 2500 μm or less, about 2000 μm or less, about 1500 μm or less, about 1000 μm or less, about 900 μm or less, about 800 μm or less, or about 700 μm or less. Thus, the width of each groove can independently be within the range bounded by any two of the foregoing endpoints. For example, the width can be about 10 μm to about 5000 μm, about 100 μm to about 2500

μm, or about 500 μm to about 1000 μm. Preferably, the width of each groove independently is about 500 μm to about 1000 μm.

Each groove in the plurality of grooves can be separated by an adjacent groove by any suitable pitch. Typically, the pitch between two adjacent grooves is larger than the width of one or both of the adjacent grooves. The pitch can be constant or vary throughout the polishing pad. The pitch values described herein can be combined in any suitable manner so as to describe a polishing pad of the invention having two or more pitch values. For example, the pitch can be about 10 μm or more, e.g., about 500 μm or more, or about 1000 μm or more. Alternatively, or in addition, the pitch can be about 10000 μm or less, about 7500 μm or less, or about 5000 μm or less. Thus, the pitch between adjacent grooves can be within the range bounded by any two of the foregoing endpoints. For example, the pitch can be about 10 μm to about 10000 μm, about 500 μm to about 7500 μm, or about 1000 μm to about 5000 μm.

In some embodiments of the invention, at least a portion of an area surrounding one or more of the centers of concentricity does not comprise any grooves, and the area typically has a radius greater than the pitch of the grooves immediately surrounding the area. In the context of a polishing pad having at least two centers of concentricity (i.e., a first center of concentricity and a second center of concentricity), at least a portion of an area surrounding the first center of concentricity, the second center of concentricity, or both, does not comprise any grooves, wherein the area has a radius greater than at least one of the first pitch (i.e., the pitch of the first plurality of concentric grooves) or the second pitch (i.e., the pitch of the second plurality of concentric grooves). In other embodiments, the polishing pad of the invention does not contain an area surrounding any centers of concentricity, wherein the area is defined as not comprising grooves and having a radius greater than the pitch of the grooves surrounding the area.

The polishing pad of the invention can comprise, consist essentially of, or consist of any suitable material. The material can be any suitable polymer and/or polymer resin. For example, the polishing pad can comprise elastomers, polyurethanes, polyolefins, polycarbonates, polyvinylalcohols, nylons, elastomeric rubbers, styrenic polymers, polyaromatics, fluoropolymers, polyimides, cross-linked polyurethanes, cross-linked polyolefins, polyethers, polyesters, polyacrylates, elastomeric polyethylenes, polytetrafluoroethylenes, polyethyleneteraphthalates, polyimides, polyaramides, polyarylenes, polystyrenes, polymethylmethacrylates, copolymers and block copolymers thereof, and mixtures and blends thereof. The polymer and/or polymer resin can be a thermoset or thermoplastic polymer and/or polymer resin. Polishing pads comprising thermoplastic polymers, such as thermoplastic polyurethanes, generally result in polished substrates having lower defects than a substrate polished with a polishing pad comprising a thennoset polymer. However, polishing pads comprised of thermoplastic polymers generally exhibit a lower polishing rate than comparable polishing pads comprised of thermoset polymers, which lower polishing rate can adversely affect the time and costs associated with the polishing process. Preferably the material comprises a thermoplastic polyurethane (e.g., EPIC D100 available from Cabot Microelectronics Corporation). Suitable polishing pad materials and suitable properties of a polishing pad material are described in U.S. Pat. No. 6,896,593, which is incorporated by reference in its entirety herein.

The polishing pad of the invention can be produced by any suitable method known in the art. For example, the polishing pad can be formed by film or sheet extrusion, injection molding, blow molding, thermoforming, compression molding, co-extrusion molding, reaction injection molding, profile extrusion molding, rotational molding, gas injection molding, film insert molding, foaming, casting, compression, or any combination thereof. When the polishing pad is made of, for example, a thermoplastic material (e.g., a thermoplastic polyurethane), the thermoplastic material can be heated to a temperature at which it will flow and is then formed into a desired shape by, for example, casting or extrusion.

The plurality of grooves can be formed in the polishing pad of the invention in any suitable manner known in the art. For example, the plurality of grooves may be formed by molding, machine cutting, laser cutting, and combinations thereof. The grooves may be molded at the same time as the fabrication of a polishing pad, or the polishing pad may first be fabricated, and then either (a) a grooving pattern molded on the surface of the polishing pad so as to form the polishing surface, or (b) a grooving pattern formed in a separate layer by any suitable means, which separate layer is then affixed by any suitable means to the surface of the polishing pad to form the polishing surface. When the grooves are formed by machine cutting or laser cutting, the polishing pad is typically formed first, and then a cutting tool or laser tool, respectively, produces grooves of a desired shape in the polishing surface of the polishing pad. Suitable grooving techniques are described in, e.g., U.S. Pat. No. 7,234,224, which is incorporated by reference in its entirety herein.

The polishing pad of the invention may contain a light-transmitting region through which light may pass in order to monitor the polishing progress by way of an in situ end-point detection (EPD) system, e.g., to determine when a desired degree of planarization has been attained. The light-transmitting region typically is in the form of an aperture or window that has translucency to light, which allows light that has passed through the light-transmitting region to be detected by the EPD system. Suitable light-transmitting regions that may be used with the polishing pad of the invention are described in U.S. Pat. No. 7,614,933, which is incorporated by reference in its entirety herein. The plurality of grooves may or may not be provided on the surface of the light-transmitting region, depending on the manufacturing method and the desired properties of the polishing pad and/or light-transmitting region.

The polishing pad of the invention can comprise the plurality of grooves as described herein in combination with any suitable grooving pattern known in the art. For example, the inventive grooving pattern can be combined with one or multiple x-axis grooves, one or multiple y-axis grooves, grooves concentric about the axis of rotation, grooves that intersect at or near the axis of rotation of the polishing pad and exit at the edge of the polishing pad (so as to form a pizza-like groove pattern), and combinations thereof.

The invention also provides a method of chemical-mechanically polishing a substrate, which method comprises, consists essentially of, or consists of (a) contacting a substrate with a polishing pad of the invention as described herein and a chemical-mechanical polishing composition, (b) moving the polishing pad relative to the substrate with the chemical-mechanical polishing composition therebetween, and (c) abrading at least a portion of the substrate to polish the substrate.

Any suitable substrate or substrate material can be employed in the polishing method. For example, the substrates can include memory storage devices, semiconductor substrates, and glass substrates. Suitable substrates for use in the method include memory disks, rigid disks, magnetic heads, MEMS devices, semiconductor wafers, field emission displays, and other microelectronic substrates, especially substrates comprising insulating layers (e.g., silicon dioxide, silicon nitride, or low dielectric materials) and/or metal-containing layers (e.g., copper, tantalum, tungsten, aluminum, nickel, titanium, platinum, ruthenium, rhodium, iridium or other noble metals). Preferably the substrate comprises copper.

The method can utilize any suitable polishing composition. The polishing composition typically comprises an aqueous carrier, a pH adjustor, and optionally an abrasive. Depending on the type of workpiece being polished, the polishing composition optionally can further comprise oxidizing agents, organic or inorganic acids, complexing agents, pH buffers, surfactants, corrosion inhibitors, anti-foaming agents, and the like. When the substrate is comprised of tungsten, a preferred polishing composition comprises colloidally stable fumed silica as an abrasive, hydrogen peroxide as an oxidizing agent, and water (e.g., the SEMI-SPERSE W2000 polishing composition available from Cabot Microelectronics Corporation).

Figure 6A:
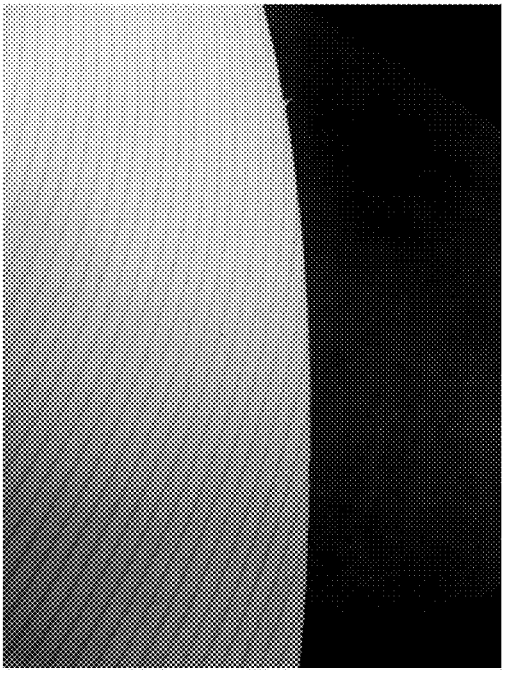
FIG. 6A depicts an image of the edge of a conventional polishing pad having an offset concentric groove pattern.
Figure 6B:
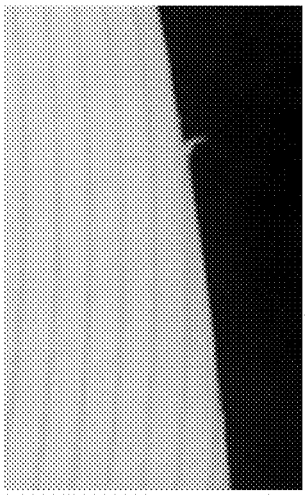
FIG. 6B is the image shown in FIG. 6A at higher magnification.
Figure 7A:
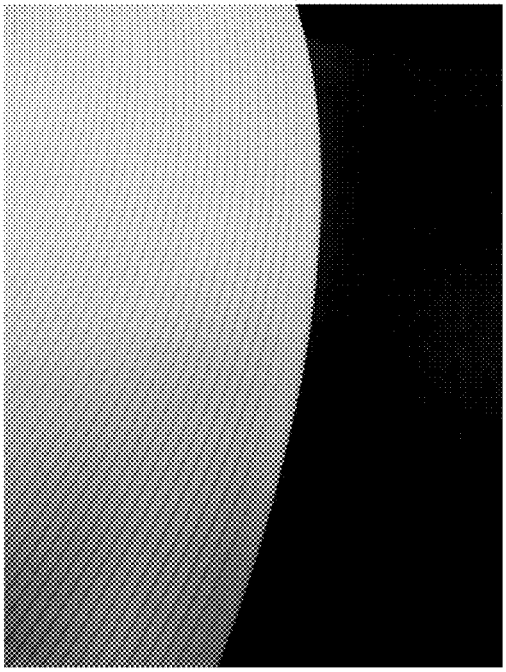
FIG. 7A depicts an image of the edge of a polishing pad in accordance with an embodiment of the invention having an offset concentric groove pattern.
Figure 7B:
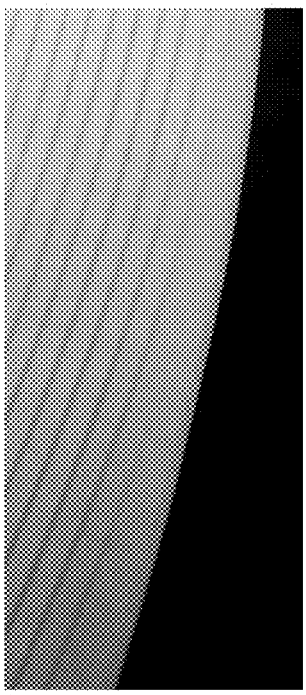
FIG. 7B is the image shown in FIG. 7A at higher magnification.

Advantageously, the polishing of substrates with the inventive polishing pad disclosed herein comprising offset concentric grooves, offset spiral grooves, or offset concentric polygonal grooves and an exclusion region results in the production of fewer substrate scratches, as compared to the polishing of substrates having offset grooving patterns and without an exclusion region as defined herein. FIG. 6A illustrates an edge of a conventional polishing pad having an offset concentric groove pattern and not having an exclusion region. FIG. 6B shows the image of FIG. 6A at higher magnification. FIG. 7A illustrates an edge of an inventive polishing pad having an offset concentric groove pattern and having an exclusion region. FIG. 7B shows the image of FIG. 7A at higher magnification. A defect at the end of a groove along the circumference of the conventional polishing pad not having an exclusion region is evident in the images depicted in FIGS. 6A and 6B, which defect is not present in the inventive polishing pad as shown in FIGS. 7A and 7B. The presence of the defect is believed to contribute to scratching of substrates polished with the polishing pad. A polished substrate produced using the inventive polishing pad described herein has an excellent degree of planarity and low defects, particularly, reduced scratching, thereby making the inventive polishing pad suitable for use in CMP processes designed to produce polished substrates for a variety of applications.

The following example further illustrates the invention but, of course, should not be construed as in any way limiting its scope.

EXAMPLE

This example demonstrates the reduction in scratching achievable by a polishing pad in accordance with an embodiment of the invention as compared to a conventional polishing pad.

Separate substrates comprising a blanket layer of copper were polished with a polishing composition in conjunction with Polishing Pad A (comparative) or Polishing Pad B (invention). Both Polishing Pad A and Polishing Pad B featured concentric grooves set into the polishing pad surface, with a center of concentricity that was about 3 cm displaced from the center of rotation of the polishing pads. Polishing Pad A did not have an exclusion region. Polishing Pad B had an exclusion region with an average distance from the circumference of the polishing pad to the inner boundary of the exclusion region of about 0.5 cm. Four substrates were polished using Polishing Pad A, and two substrates were polished using Polishing Pad B. Following polishing, the substrate surfaces were examined using an optical method to determine the total defect count. The results are set forth in the Table.

TABLE

| | Substrate Defect Count | |
|---|---|---|
| Substrate # | Polishing Pad A (comparative) | Polishing Pad B (invention) |
| 1 | 246 | 196 |
| 2 | 238 | 156 |
| 3 | 288 | — |
| 4 | 355 | — |
| Average Substrate Defect Count | 277 | 175 |

As is apparent from the results set forth in the Table, the defect count observed on substrates polished with the inventive polishing pad, which had an exclusion region, was approximately 64% of the defect count observed on substrates polished with the comparative polishing pad, which did not have an exclusion region.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A polishing pad, wherein the polishing pad is characterized by a generally circular cross section, wherein the polishing pad comprises an axis of rotation and a polishing surface, wherein the polishing surface comprises at least a grooved region and an exclusion region, wherein the grooved region comprises a plurality of grooves set into the polishing surface, wherein the plurality of grooves is composed of at least a first plurality of concentric grooves having a first center of concentricity, wherein the axis of rotation of the polishing pad is not coincident with the first center of concentricity, wherein the plurality of grooves is further composed of a second plurality of concentric grooves having a second center of concentricity, wherein the first center of concentricity is not coincident with the second center of concentricity, and wherein the axis of rotation of the polishing pad is not coincident with the first center of concentricity and the second center of concentricity, wherein the exclusion region is devoid of grooves, wherein the exclusion region is adjacent to the circumference of the polishing pad, wherein the exclusion region has an outer boundary and an inner boundary, wherein the outer boundary of the exclusion region is contiguous with the circumference of the polishing pad, and wherein a distance from the circumference of the polishing pad to the inner boundary of the exclusion region is greater than zero.

2. The polishing pad of claim 1, wherein an average distance from the circumference of the polishing pad to the inner boundary of the exclusion region is denoted by $D_A$, and wherein $D_A$ is about 0.1 cm to about 2 cm.

3. The polishing pad of claim 2, wherein $D_A$ is about 1 cm to about 1.5 cm.

4. The polishing pad of claim 3, wherein $D_A$ has a standard deviation of about 0.5 or less.

5. A method of chemical-mechanically polishing a substrate, which method comprises:

(a) contacting a substrate with a chemical-mechanical polishing composition and the polishing pad of claim 1, (b) moving the polishing pad relative to the substrate with the chemical-mechanical polishing composition therebetween, and (c) abrading at least a portion of the substrate to polish the substrate.

6. The method of claim 5, wherein a defect count on a surface of the substrate is lower than the defect count on the surface of the substrate when using an otherwise identical polishing pad that does not contain the exclusion region under identical polishing conditions.

7. The method of claim 5, wherein the substrate comprises copper, and wherein at least some of the copper is removed from the substrate to polish the substrate.

* * * * *